US005287158A

United States Patent [19]

Nagashima et al.

[11] Patent Number: 5,287,158

[45] Date of Patent: Feb. 15, 1994

[54] IMAGE FORMING APPARATUS WITH IMAGE READING UNIT

[75] Inventors: Hiroyuki Nagashima, Yokohama; Akira Suga, Tokyo, both of Japan

[73] Assignee: Ricoh Company, Ltd., Tokyo, Japan

[21] Appl. No.: 990,529

[22] Filed: Dec. 15, 1992

[30] Foreign Application Priority Data

Dec. 16, 1991 [JP] Japan ..... 3-332249

[51] Int. Cl.[5] ..... G03G 21/00; G03G 15/00

[52] U.S. Cl. ..... 355/309; 271/258; 271/265; 355/204; 355/208; 355/209

[58] Field of Search ..... 355/203, 204, 205, 206, 355/207, 208, 308, 309, 317, 319; 271/256, 258, 264, 265

[56] References Cited

U.S. PATENT DOCUMENTS

| | | | |
|---|---|---|---|
| 4,924,275 | 5/1990 | Nelson | 355/319 |
| 5,005,049 | 4/1991 | Matsushita | 355/208 |
| 5,038,182 | 8/1991 | Tanimoto | 355/204 X |

FOREIGN PATENT DOCUMENTS

| | | |
|---|---|---|
| 63-311263 | 12/1988 | Japan . |
| 1-38763 | 2/1989 | Japan . |
| 2-17466 | 1/1990 | Japan . |
| 2-166962 | 6/1990 | Japan . |

*Primary Examiner*—A. T. Grimley
*Assistant Examiner*—Sandra L. Brasé
*Attorney, Agent, or Firm*—Cooper & Dunham

[57] ABSTRACT

An image forming apparatus includes a printing unit for printing an image on a paper, a paper feed mechanism for feeding a paper to said printing unit, a paper supply cassette for forwarding papers, one by one, to said paper feed mechanism, an optical sensor for detecting whether or not a surface of each paper, fed to said printing unit by said paper feed mechanism, is blank, and an ejecting unit for ejecting a paper from said paper feed mechanism without printing an image thereon when said optical sensor detects that the surface of the paper is not blank, so that only papers having blank surfaces are fed to said printing unit.

12 Claims, 10 Drawing Sheets

IMAGE FORMING APPARATUS WITH IMAGE READING UNIT

BACKGROUND OF THE INVENTION

1. Field of the Invention

The present invention relates to an image forming apparatus, such as a printer, a copy machine and a facsimile machine, with an image reading unit.

2. Description of Related Art

FIG. 1 and FIG. 2 respectively show a conventional facsimile machine and a copy machine respectively disclosed in Japanese Patent Laid Open Applications No. 2-166962 and No. 2-17466. In the image forming apparatus such as the conventional facsimile machine and copy machine, a feed path 101 through which documents to be read are fed and a feed path 103 through which recording papers are fed to an image forming unit 102 are separated from each other. That is, the conventional image forming apparatus is provided with the two feed paths 101 and 103 respectively corresponding to an image reading process and an image forming process.

To achieve down sizing of the image forming apparatus with the image reading unit, the applicant has proposed that a feed path be used for two purposes; first, to feed documents to be read by an optical sensor, and second, to feed recording papers on which images are to be formed by an image forming unit (not published). However, as the feed path is used for feeding both documents and recording papers, if errors are made in operations, images may be formed, by mistake, on documents to be read. In this case, the documents are spoiled.

SUMMARY OF THE INVENTION

Accordingly, a general object of the present invention is to provide a novel and useful image forming apparatus with an image reading unit in which apparatus the disadvantages of the aforementioned prior art are eliminated.

A more specific object of the present invention is to provide an image forming apparatus with an image reading unit in which apparatus images can be prevented from being formed on documents even if the documents are mistakenly fed toward an image forming unit.

The above objects of the present invention are achieved by an image forming apparatus comprising: printing means for printing an image on a paper; a paper feed means for feeding a paper to the printing means; paper supplying means, coupled to the paper feed means, for supplying papers one by one to the paper feed means; detecting means for detecting whether or not a surface of each paper, fed to the printing means by the paper feed means, is blank; and ejecting means, coupled to the detecting means, for ejecting a paper from the paper feed means without printing an image thereon when the detecting means detects that the surface of the paper is not blank, so that only papers having blank surfaces are fed to the printing means.

According to the present invention, if recording papers stacked in the paper supply cassette are mixed with documents, the documents are ejected from a paper feed path and thus, even in this situation, only recording papers having blank surfaces are fed to the printing unit.

Additional objects, features and advantages of the present invention will become apparent from the following detailed description when read in conjunction with the accompanying drawings.

DESCRIPTION OF THE PREFERRED EMBODIMENTS

A description will now be given of an embodiment of the present invention.

Figure 1:
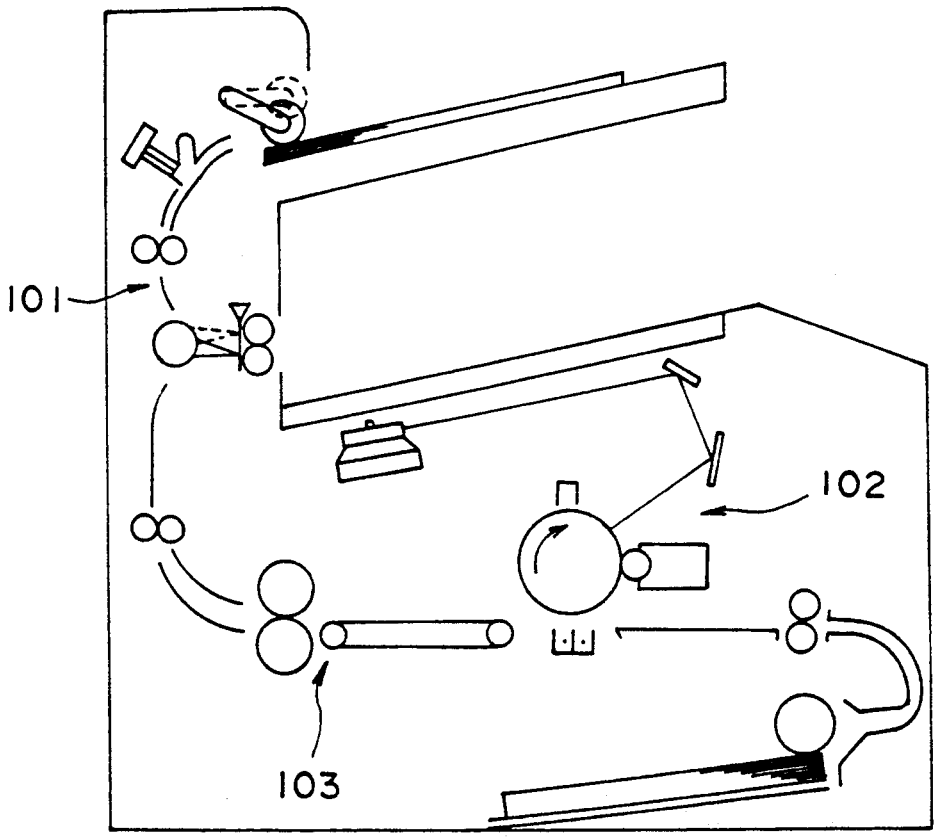
FIG. 1 (PRIOR ART)
FIG. 1 is a diagram illustrating a conventional facsimile machine.
Figure 2:
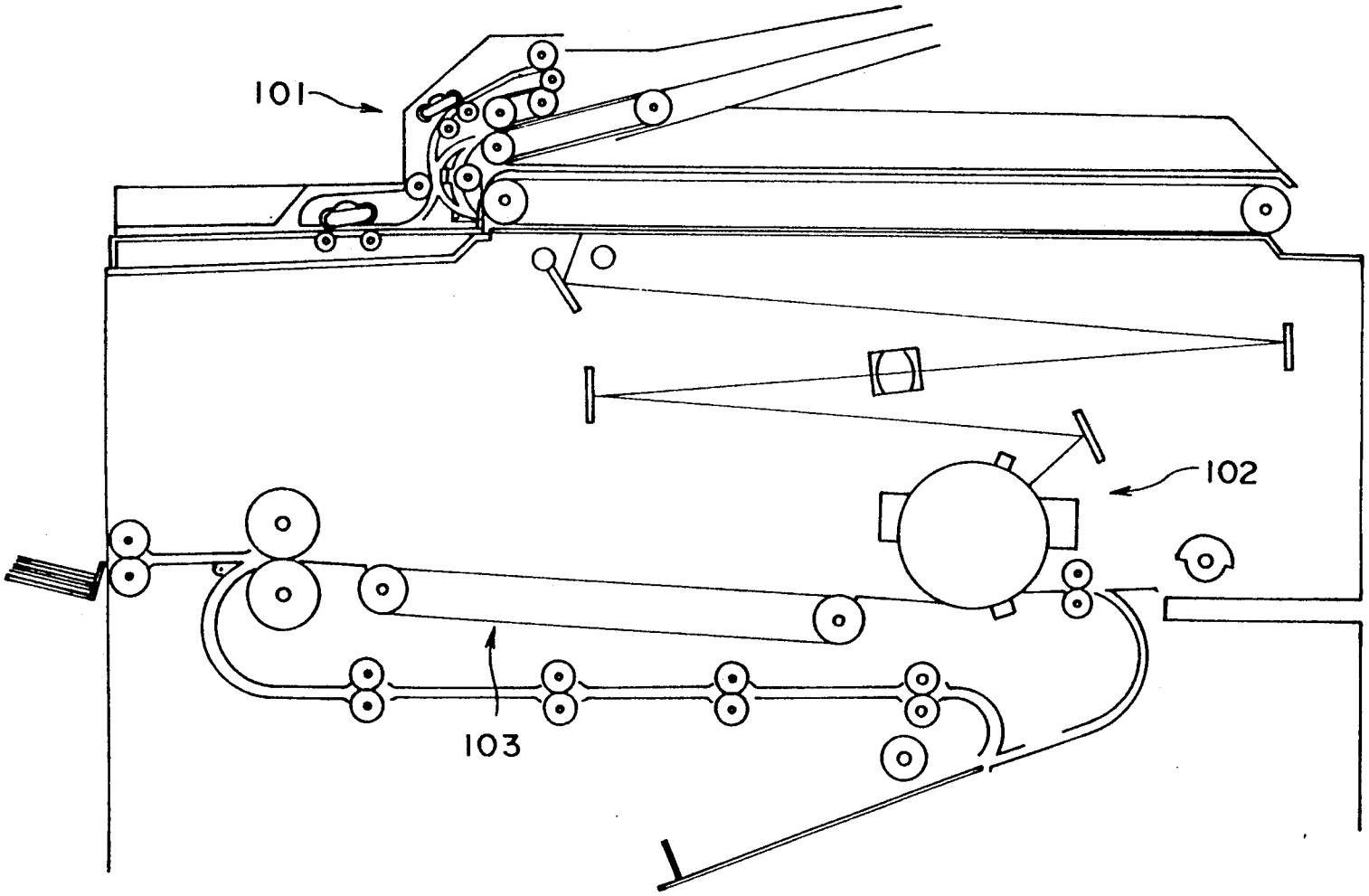
FIG. 2 (PRIOR ART)
FIG. 2 is a diagram illustrating a conventional copy machine.
Figure 3:
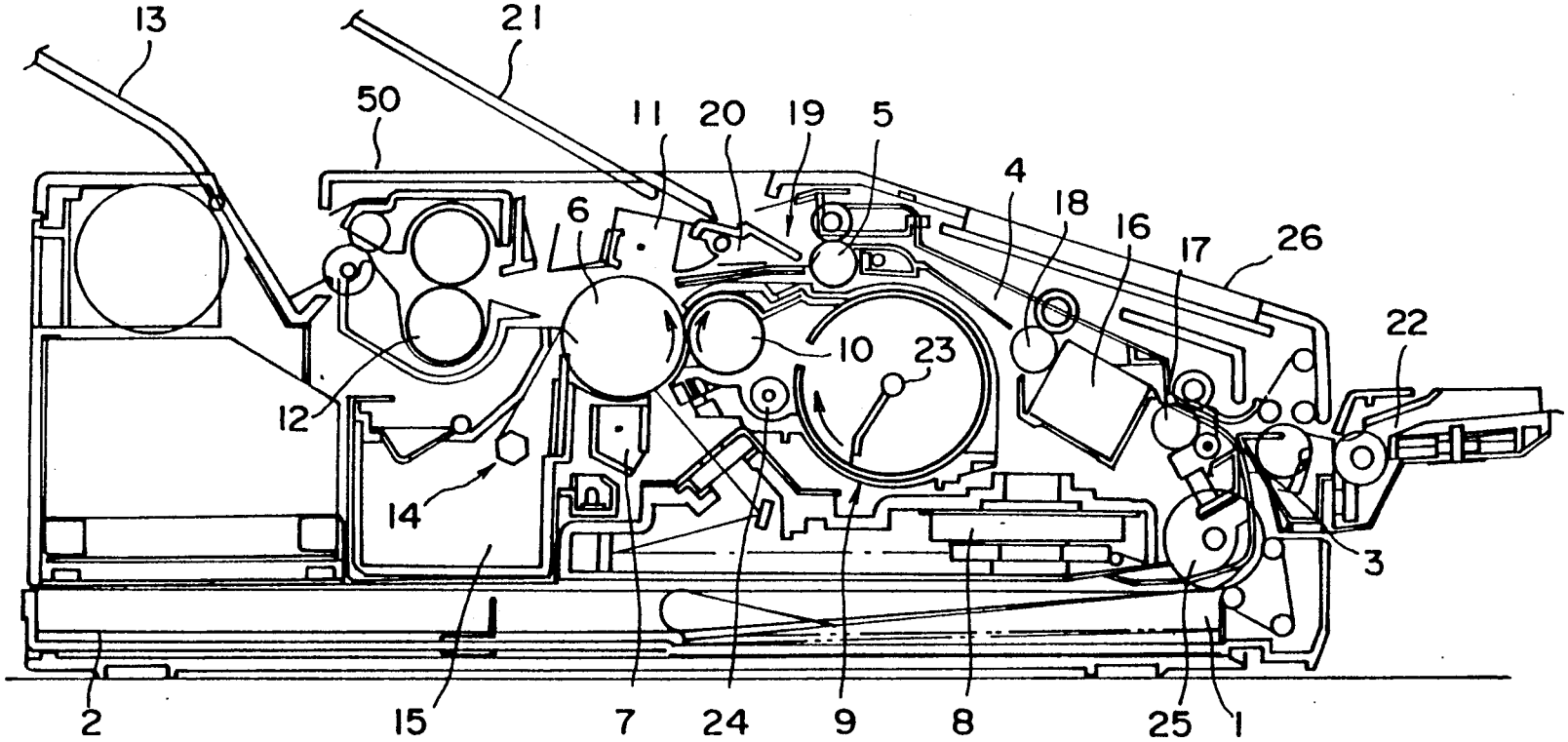
FIG. 3 is a diagram illustrating a printer according to an embodiment of the present invention.

Referring to FIG. 3, which shows a printer for making prints in accordance with an electrophotographic process, a paper supply cassette 1 is detachably mounted on a bottom plate of a housing 50. Recording papers are stacked in the paper supply cassette 1. A supplying path 3 extends from the paper supply cassette 1 to timing rollers 17. A supply roller 25 is arranged so as to be in contact with a paper in the paper supply cassette 1. The paper supply roller 25 forwards papers in the paper supply cassette 1, one by one, to the supplying path 3. A feed path 4 extends from the timing rollers 17 to a pair of registration rollers 5. A branch path 19 is formed at the downstream side of the registration rollers 5. That is, the feed path 4 branches out into the branch path 19 and a path extending toward a photosensitive drum 6. A branch guide 20 is pivotably provided at a position at which the branch path 19 and the path extending toward the photosensitive drum 6 are separated. The branch path 19 extends to a second ejection tray 21 which obliquely projects from a top plate of the housing 50.

The photosensitive drum 6 rotated in a counterclockwise direction is surrounded by a charging device 7, a developing device 9, a transfer device 11, and a cleaning device 14. An optical writing system 8 (including a laser device) is provided above the paper supply cassette 1. A laser beam modulated in accordance with image information and emitted from the optical writing system 8 passes between the charging device 7 and the developing device 9 and is projected onto the surface of the photosensitive drum 6. The developing device 9 is provided with an agitator 23, an intermediate roller 24 and a developing roller 10. Toner agitated by the agitator 23 is transmitted to the developing roller 24 via the intermediate roller 24, and the developing roller 24 uniformly supplies the toner to the surface of the photosensitive drum 6. The electrophotographic process is carried out on the photosensitive drum 6 by the charging device 7, the optical writing device 8, the developing device 9 and the transfer device 11. That is, the laser beam is projected onto the photosensitive drum 6 uniformly charged by the charging device 7, and an electrostatic latent image is formed on the photosensitive drum 7. Then, the electrostatic latent image is developed by the developing device 9 so that a toner image corresponding to the electrostatic latent image is formed on the photosensitive drum 6. The toner image is transferred, by the transfer device 11, from the photosensitive drum 6 to a recording paper supplied between the photosensitive drum 6 and the transfer device 11. After the transference of the toner image, remaining toner on the photosensitive drum 6 is removed by the cleaning device 14 and stored in a toner tank 15. A fixing device 12 is arranged at the downstream side of the photosensitive drum 6. The toner image is fused and fixed on the recording paper by the fixing device 12. A first ejection tray 13 is arranged at the downstream side of the fixing device 13 so as to obliquely project from the top plate of the housing 50.

An image sensor 16 is provided so as to face the feed path 4 at the downstream side of the timing rollers 17. Feed rollers 18 are provided in the feed path at the downstream side of the image sensor 16.

In a case where image information on documents are read, the paper supply cassette 1 in which the documents are stacked is set in the housing 50. The documents are forwarded, one by one, from the paper supply cassette 1 to the supplying path 3 by the supply roller 25. A document forwarded from the paper supply cassette 1 passes through the supplying path 3, and is forwarded to the feed path 4 by the timing rollers 17 at a predetermined timing. While the document is being fed by the feed rollers 18 through the feed path 4, the image information on the document is optically read by the image sensor 16. After that, the document is forwarded by the registration rollers 5 to the blanch guide 20 and guided to the blanch path 19 by the blanch guide 20. Then the document passes through the blanch path 19 and is ejected to the second ejection tray 21.

In a case where the image forming is performed, the paper cassette 1 in which recording papers substituted for the documents are stacked is set in the housing 50. The recording papers are fed, one by one, from the paper supply cassette 1 to the registration rollers 5 via the supplying path 3 and the feed path 4 in the same manner as the above documents. In this case, the blanch guide 20 is switched so as to select the path extending toward the photosensitive drum 6. Thus, a recording paper forwarded to the blanch guide 20 by the registration roller 5 at a predetermined timing is guided toward the photosensitive drum 6. Then, when the recording paper passes between the photosensitive drum 6 and the transfer device 11, toner images formed in accordance with the electrophotographic process are transferred from the photosensitive drum 6 to the recording paper. The recording paper on which the toner image is formed passes through the fixing device 12 and is ejected to the first ejection tray 13.

In addition, a manual-feed fed paper supplying device 22 is mounted at a front end of the housing 50. An operator may supply documents or recording papers one by one using the manual-feed fed paper supplying device 22 by hand. Papers set in the manual-feed fed paper supplying device 22 are forwarded from the manual-feed fed paper supplying device 22 to the timing rollers 17.

Figure 4:
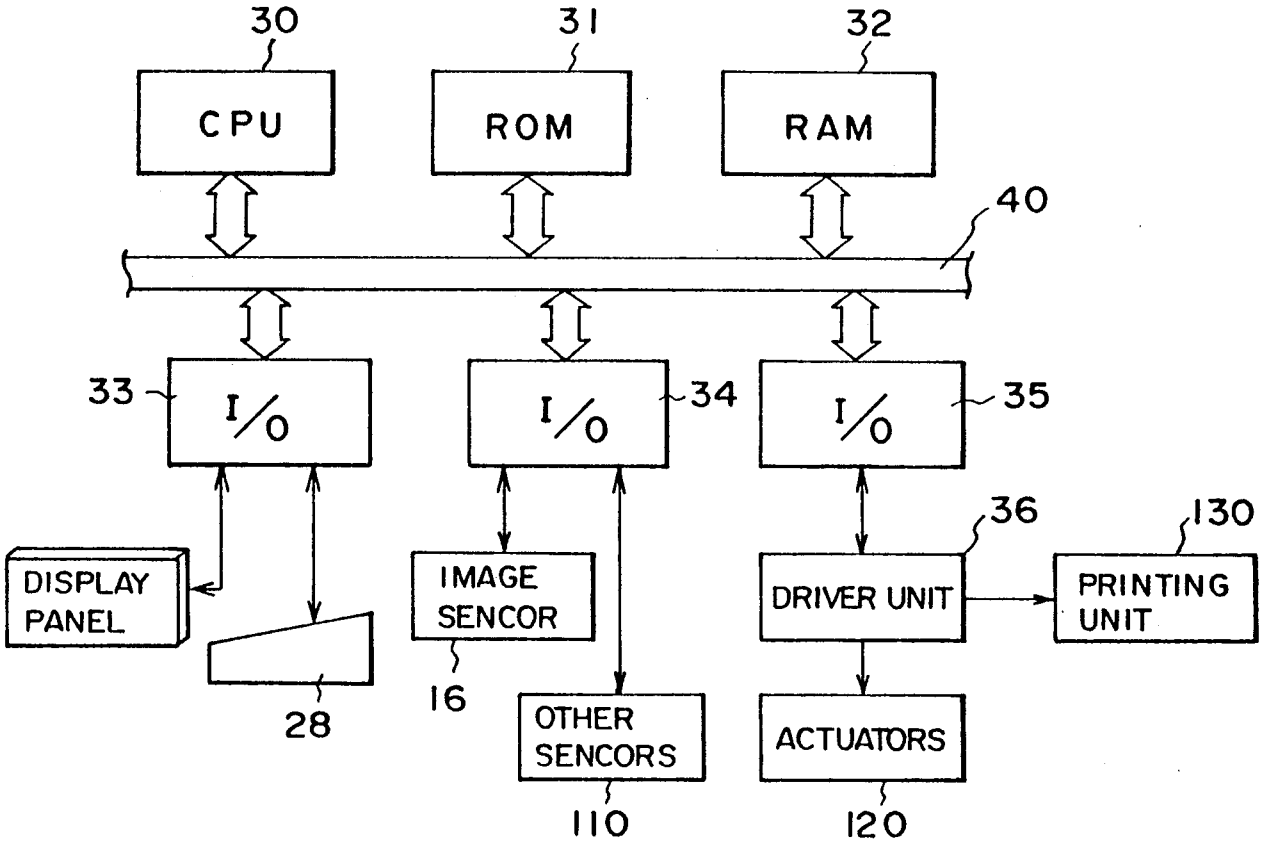
FIG. 4 is a block diagram illustrating a controller of the printer shown in FIG. 3.

FIG. 4 shows a controller of the printer shown in FIG. 3.

Figure 5:
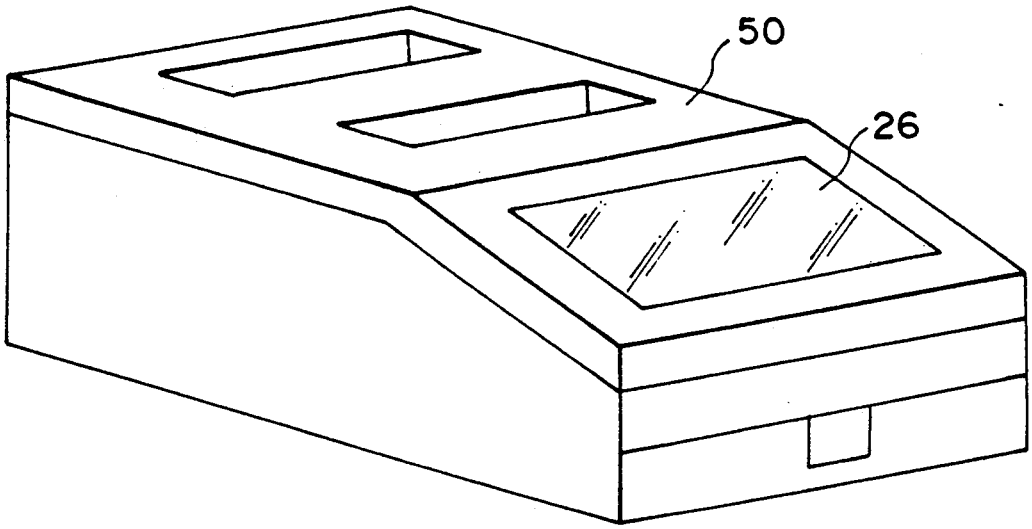
FIG. 5 is a perspective view illustrating a display panel mounted on a front panel of the printer shown in FIG. 3.

Referring to FIG. 4, the controller comprises a CPU 30 (Central Processing Unit), a ROM 31 (Read Only Memory), a RAM 32 (Random Access Memory), and interface circuits 33, 34 and 35. The CPU 30, the ROM 31, the RAM 32 and the interface circuits 33, 34 and 35 are coupled to each other by a bus 40 (including a control bus, a data bus and an address bus). A display panel 26 and a keyboard 28 are coupled to the bus 40 via the interface circuit 33. The display panel 26 is mounted on a front panel of the housing 50 as shown in FIG. 5. The image sensor 16 and other sensors 110 (e.g. jam sensors, timing sensors and the like) are coupled to the bus 40 via the interface circuit 34. A driver unit 36 is coupled to the bus 40 via the interface circuit 35. The driving unit 36 drives various actuators 120 (solenoids, motors, magnetic clutches and the like) and a printing unit 130 including the photosensitive device 6, the optical writing system 8, the developing device 9 and the fixing device 12. The actuators 120 include, for example, a solenoid for driving the blanch guide 20 and a magnetic clutch provided to the feed rollers 18. The ROM 31 stores various programs, tables and the like. The CPU 30 carries out processes in accordance with the programs stored in the ROM 31. The RAM 32 has areas for storing image data and other data calculated by the CPU 30. Instruction information, image information and other detecting information is respectively supplied from the keyboard 28, the image sensor 16 and other sensors 110 to the CPU 30 via the interface circuits 33 and 34 and the bus 40. The CPU 30 supplies image data to be displayed to the display unit via the bus 40 and the interface circuit 33, and supplies control data to the driver unit 36 via the bus 40 and the interface circuit 35.

In the reading operation, while the document supplied from the paper supply cassette 1 is being fed through the feed path 4, image signals output from the image sensor 16 are converted to digital image data by the interface circuit 34 and the image data is supplied to the RAM 32 via the bus 40. The image data is then written in a predetermined area of the RAM 32 page by page in accordance with a write command output from the CPU 30.

Figure 6:
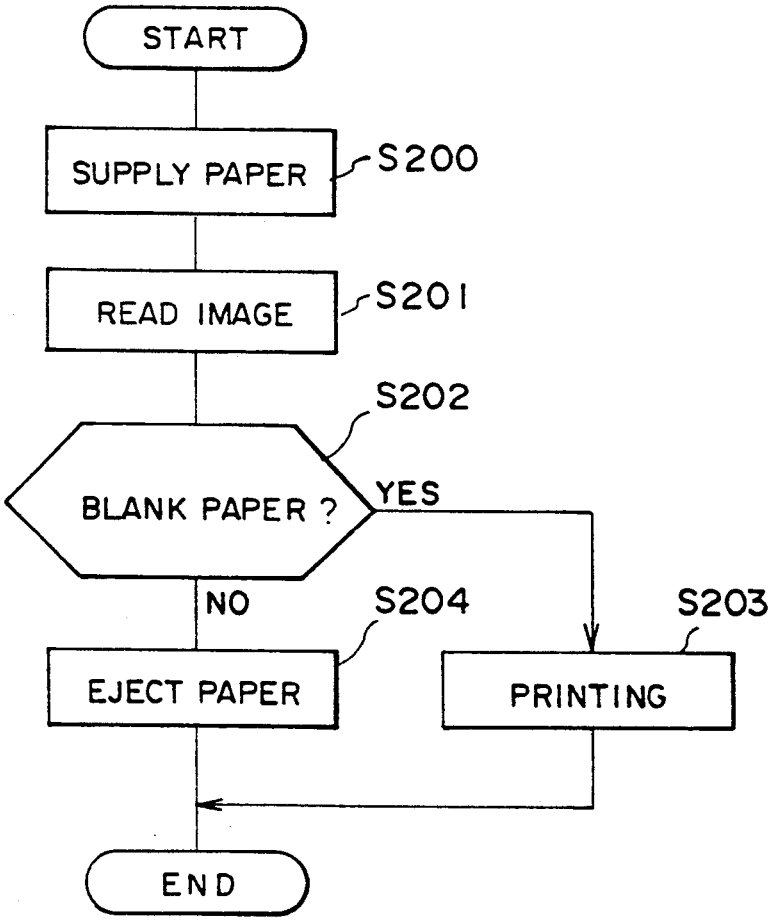
FIGS. 6, 7, 8, 9, 10 and 11 are flow charts illustrating processes performed by the controller shown in FIG. 4.

In the printing operation, the CPU 10 controls the printer in accordance with, for example, a first procedure shown in FIG. 6.

First, in step S200, the CPU 30 instructs the printer to start to supply papers to the supplying path 3. In accordance with this instruction, a paper is fed from the paper supply cassette 1 to the timing rollers 17 via the supplying path 3. Then, in step S201, when the CPU 30 outputs an instruction for reading the paper, the timing rollers 17 convey the paper to the feed path 4 and the paper is fed toward the registration rollers 5 through the feed path 4. While the paper is fed through the feed path 4, the image sensor 16 reads the paper line by line. The CPU 30 determines, in step S202, whether or not the surface of the paper is blank (for example, white) based on the image data supplied from the image sensor 16. When the CPU 30 determines that the surface of the paper is blank, the CPU 30 outputs an instruction for the printing in step S203. That is, in this case, the paper is determined as a recording sheet of paper, not as a document. Then, the blanch guide 20 is switched so as to select the path extending toward the photosensitive drum 6, and the registration rollers 5 convey the paper toward the photosensitive drum 6 based on this instruction. After that, toner images corresponding to image data stored in the RAM 32 are formed on the paper in accordance with the electrophotographic process. The paper on which the toner images are formed is fed to the first tray 13 via the fixing device 12.

On the other hand, if the CPU 30 determines, in step S202, that the surface of the paper is not blank, the CPU 30 outputs, in step 204, an instruction for ejecting the paper without printing images thereon. That is, in this case, the paper supplied from the paper supply cassette 1 is determined as a document on which various image patterns (characters, figures and the like) are formed. Then, the blanch guide 20 is switched so as to select the blanch path 19. The paper is fed by the registration rollers 5 through the blanch path 19, and is ejected to the second ejection tray 21.

According to the above embodiment, when the surface of the paper supplied from the paper supply cassette 1 is not blank, the paper is ejected to the second ejection tray 21 as it is without printing images thereon.

A case occurs, however, where a recording paper is supplied to the printer on which paper there are rule marks, a company name or the like. In this case, the recording paper is determined to be a document and is ejected to the second tray 21 without printing images thereon. To prevent this situation from occurring, the CPU 30 controls the printer in accordance with a procedure, for example, as shown in FIG. 7.

Figure 7:
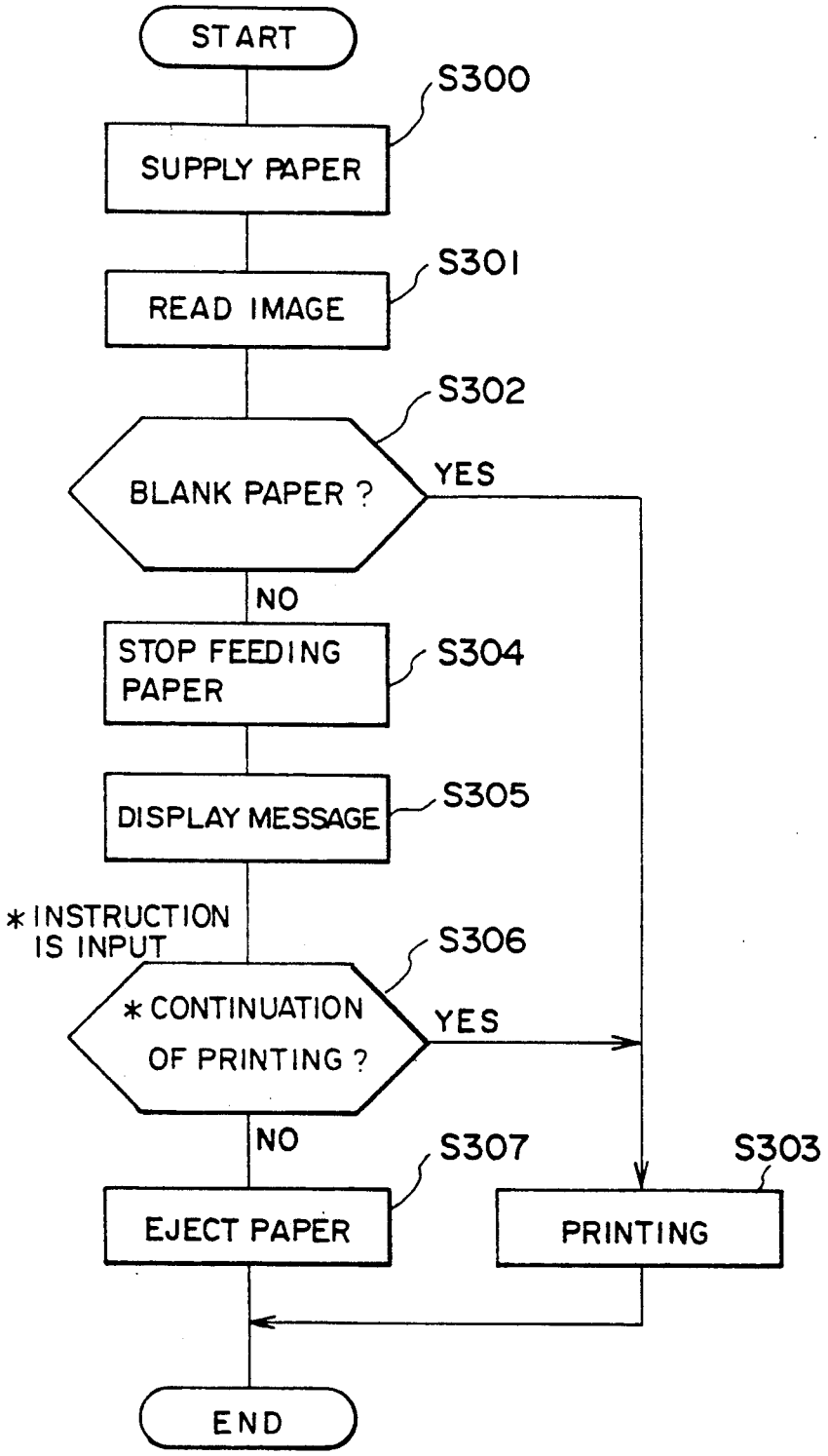

Referring to FIG. 7, the CPU 30 processes steps S300, S301 and S302 in the same manner as in the procedure shown in FIG. 6. When the CPU 30 determines that the surface of the paper is blank, images are printed on the paper in the same manner as in the above case (step S303). On the other hand, if the CPU 30 determines that the surface of the paper supplied from the paper supply cassette 1 is not blank, the CPU 30 outputs an instruction for stopping the feed of the paper in step S304. In this case, the magnetic clutch of the feed roller 18 is operated, so that the paper is stopped. In this state, the CPU 30 outputs a warning command in step S305. Then, a warning message, for example, "This paper is not a blank paper" is supplied to the display panel 26 and is displayed thereon. At this time, an operator looks at the message displayed on the display panel 26 and operates a key corresponding to a printing process on the keyboard 28 when a recording paper having the rule marks, the company name and the like printed thereon has been supplied to the printer. When a document has been mistakenly supplied to the printer, the user operates a key corresponding to an ejecting process on the keyboard 28.

After the user operates a key on the keyboard 28, the CPU 30 determines whether either the key corresponding to the printing process or the key corresponding to the ejecting process has been operated, in step S306. When the CPU 30 determines that the key corresponding to the printing process is operated in step S306, images are printed on the paper in the same manner as in the above case (step S303). On the other hand, the CPU 30 determines that the key corresponding to the ejecting process has been operated in step S306, the paper is ejected to the second tray 21 without printing images thereon in the same manner as in step S204 shown in FIG. 6 (step S307).

According to the procedure shown in FIG. 7, even if rule marks, a company name and the like are printed on a recording paper, images can be normally printed thereon.

In the above embodiment, after the paper is stopped (in step S304), a warning buzzer or a warning lamp may be also activated (in step S305).

A case may occur, where a recording paper on which only regular marks, such as rule marks and the company name, are printed is supplied to the printer. In this case, the key operation for selecting either the printing process or the ejecting process is troublesome. To eliminate the troublesome operation, the CPU 30 controls the printer in accordance with a procedure, for example, as shown in FIG. 8.

Image data corresponding to regular marks printed on a recording paper normally used in the printer has been previously sampled and stored in a predetermined area of the RAM 32 or of the ROM 32. That is, the regular marks have been previously registered in the printer. The regular marks registered in the printer are referred to as registered marks.

Figure 8:
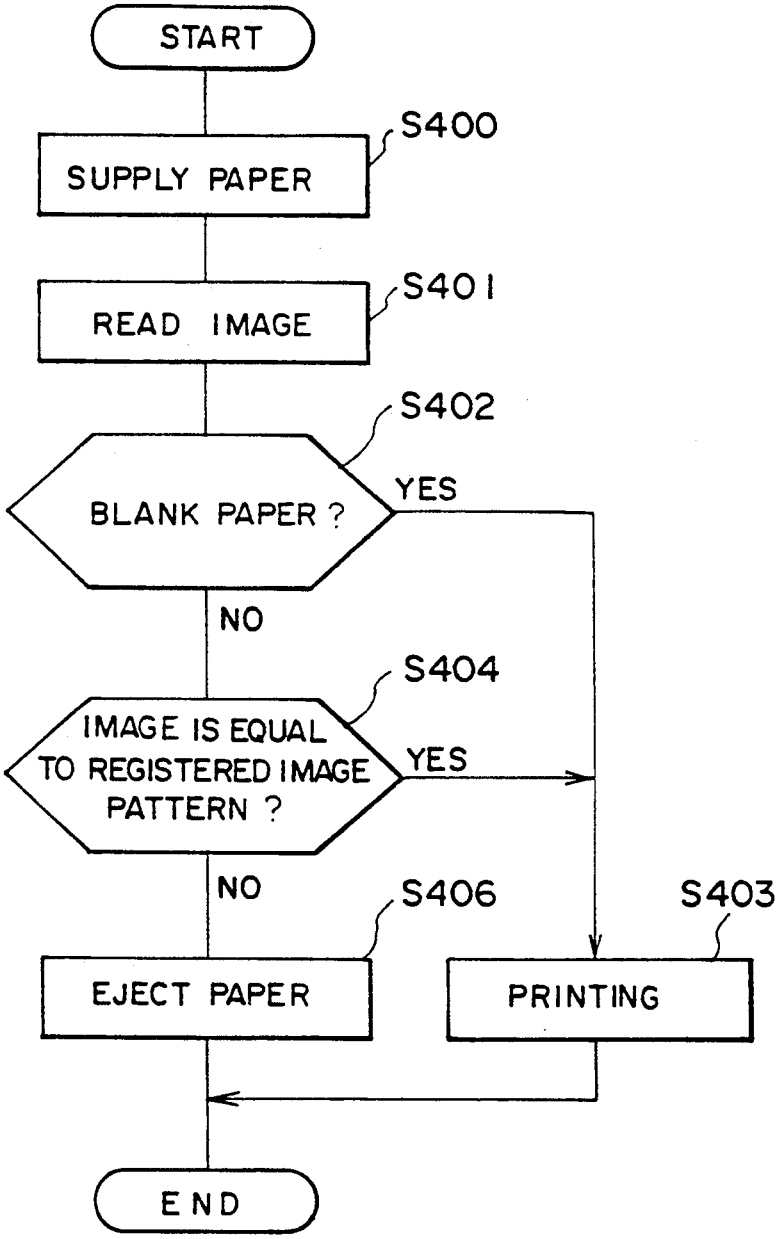

Referring to FIG. 8, the CPU 30 processes in accordance with steps S400, S401 and S402 in the same manner as in the procedures shown in FIGS. 6 and 7. When the CPU 30 determines that the surface of the paper is blank, images are printed on the paper in the same manner as in the above cases (step S403). On the other hand, when the CPU 30 determines, in step S402, that the surface of the paper supplied from the paper supply cassette 1 is not blank in step S402, the CPU 30 further determines whether or not marks extracted from image data for one page, the image data being supplied from the image sensor 16, are equal to the registered marks in step S404. When the CPU 30 determines that the extracted marks are equal to the registered marks in step S404, the printing process is carried out in the same manner as in the above cases (step S403). On the other hand, if the CPU 30 determines that the extracted marks are not equal to the registered marks, the paper is ejected to the second ejecting tray 21 without printing images thereon.

According to the procedure shown in FIG. 8, even if rule marks, a company name and the like are printed on a recording paper, images can be normally printed thereon without key operations.

A case may occur, where a recording paper is supplied to the printer on which paper appear marks differ from the regular marks. In this case, the recording sheet is determined as a document and ejected to the second ejecting tray 21 without printing images thereon. To prevent this situation from occurring, the CPU 30 controls the printer in accordance with a procedure, for example, as shown in FIG. 9.

Figure 9:
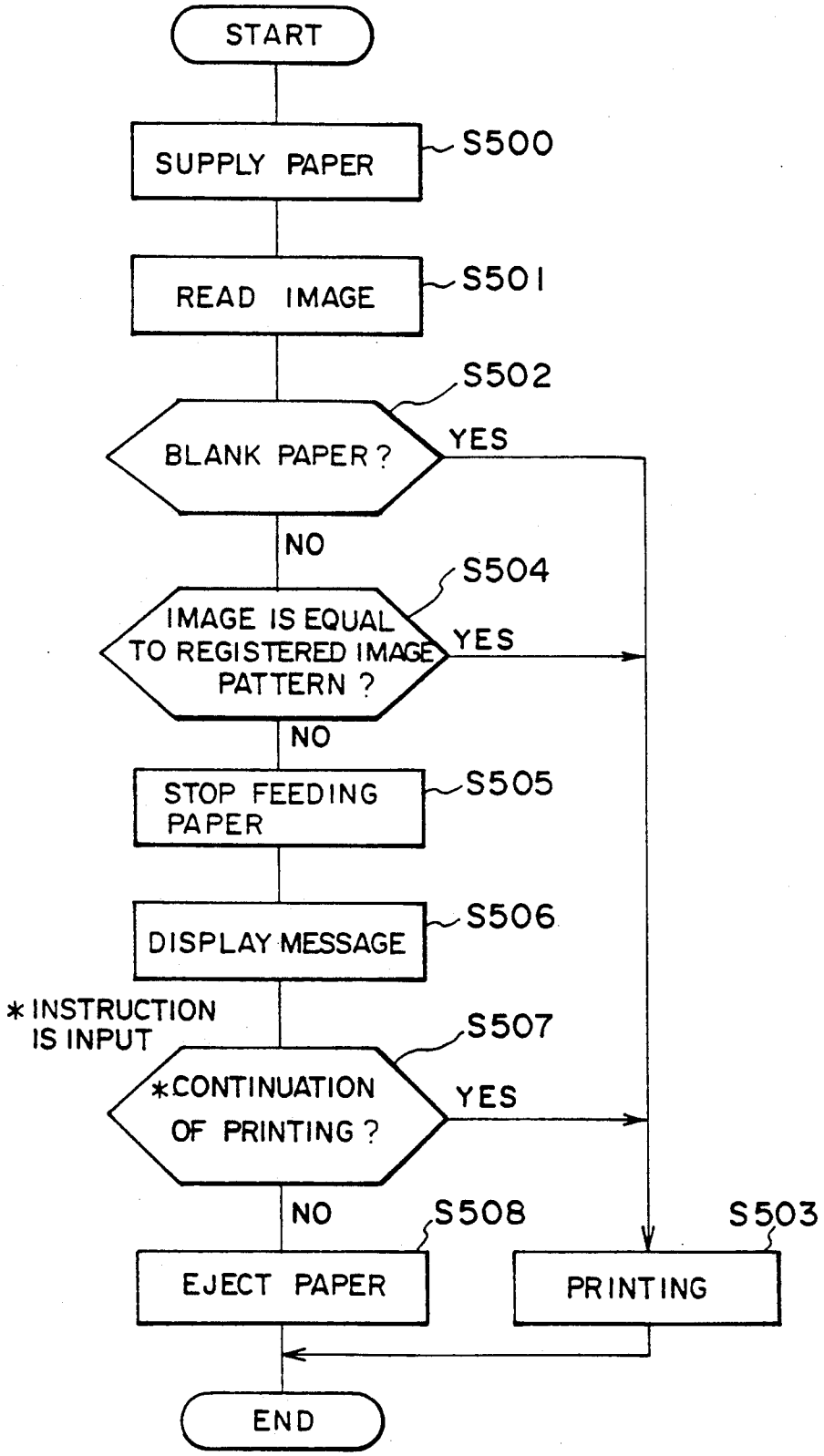

The procedure shown in FIG. 9 is obtained by a combination of the procedures shown in FIGS. 7 and 8. That is, steps S500, S501, S502, S503 and S504 shown in FIG. 9 respectively correspond to steps S400, S401, S402, S403 and S404 shown in FIG. 8, and steps S505, S506, S507 and S508 respectively correspond to steps S304, S305, S306 and S307 shown in FIG. 7. In steps S506, a message "The marks on the paper are not equal to the registered marks" is displayed on the display panel 26. The operator looks at this message displayed on the display panel 26, and performs a key operation corresponding to either the printing process or the ejecting process.

According to the procedure shown in FIG. 9, even if marks different from the registered marks are printed on a recording paper, images can be normally printed thereon.

There may be a case where the operator goes away from the printer after the paper supply cassette 1 in which recording papers are stacked is set in the housing 50. In this case, even if the warning message is displayed on the display panel 26 in step S305 shown in FIG. 7, the key operation for selecting either the printing process or the ejecting process is not carried out. Thus, the process is interrupted. To prevent this situation from occurring, the CPU 30 controls the printer in accordance with a procedure, for example, as shown in FIG. 10.

Figure 10:
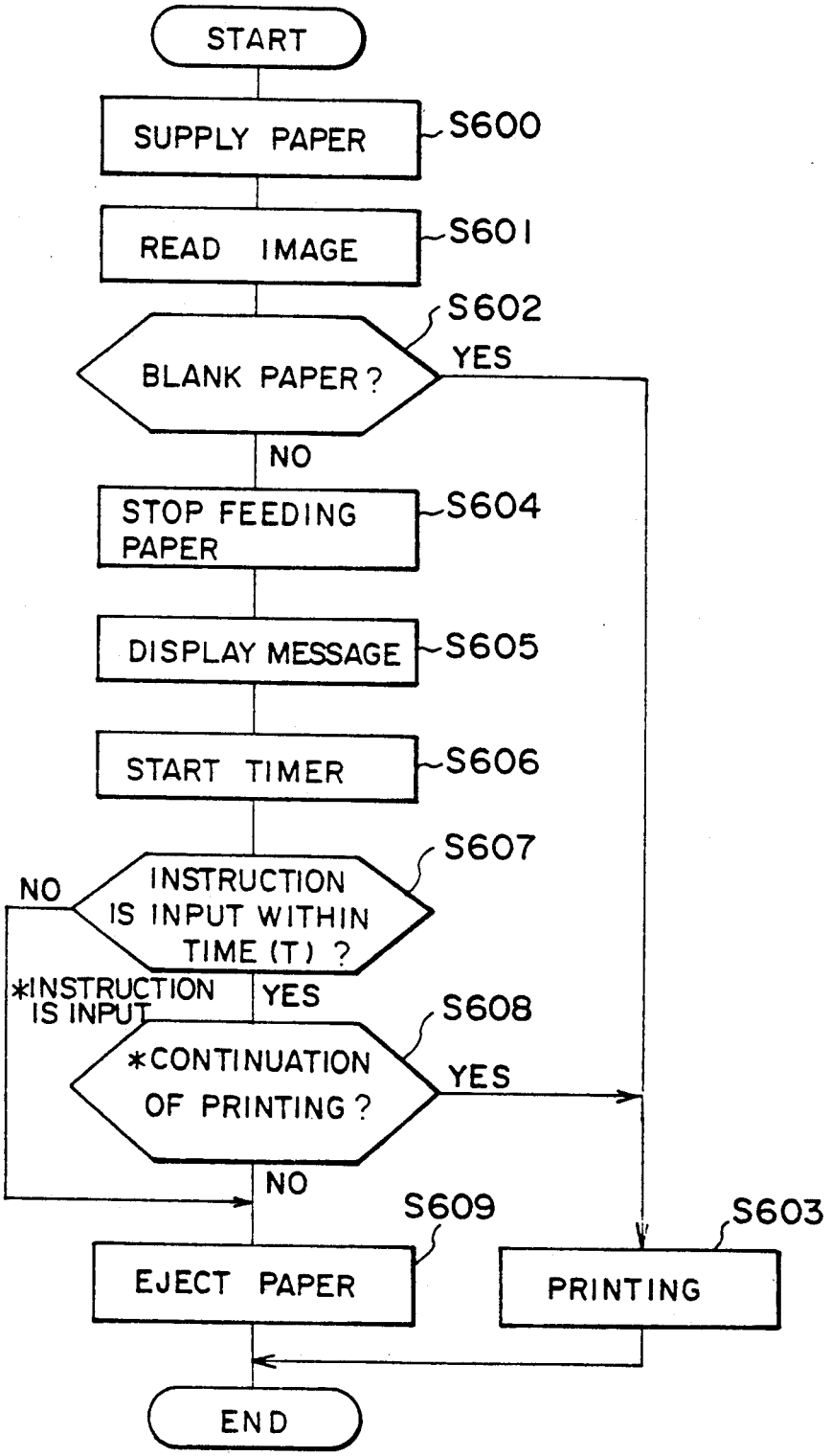

Referring to FIG. 10, a process is carried out in accordance with steps S600, S601, S602, S603, S604, S604 and S605 in the same manner as a process in steps S300, S301, S302, S303, S304 and S305 shown in FIG. 7. After the message is displayed on the display panel 26, the CPU 30 activates a timer provided in the printer so that the counting operation of the timer starts, in step S606. Then the CPU 30 determines, with reference to a counting value of the timer, whether or not a key operation is carried out on the keyboard 28 within a predetermined time, in step S607. When the CPU 30 determines that a key operation is carried out within the predetermined time, the process corresponding to the key operation (steps S608, S603 and S609) in the same manner as the process in accordance with the procedure shown in FIG. 7. On the other hand, if the CPU 30 determines that no key operation is carried out within the predetermined time, step S608 is skipped and the paper is ejected to the second ejecting tray 21 without printing images thereon (step 609).

According to the procedure shown in FIG. 10, if a key operation is not carried out within a predetermined time after the warning message is displayed on the display panel 26, the paper is automatically ejected to the second ejecting tray 21 without printing images thereon. Thus, even if the user goes away from the printer, the process is prevented from being interrupted for a long time.

Figure 11:
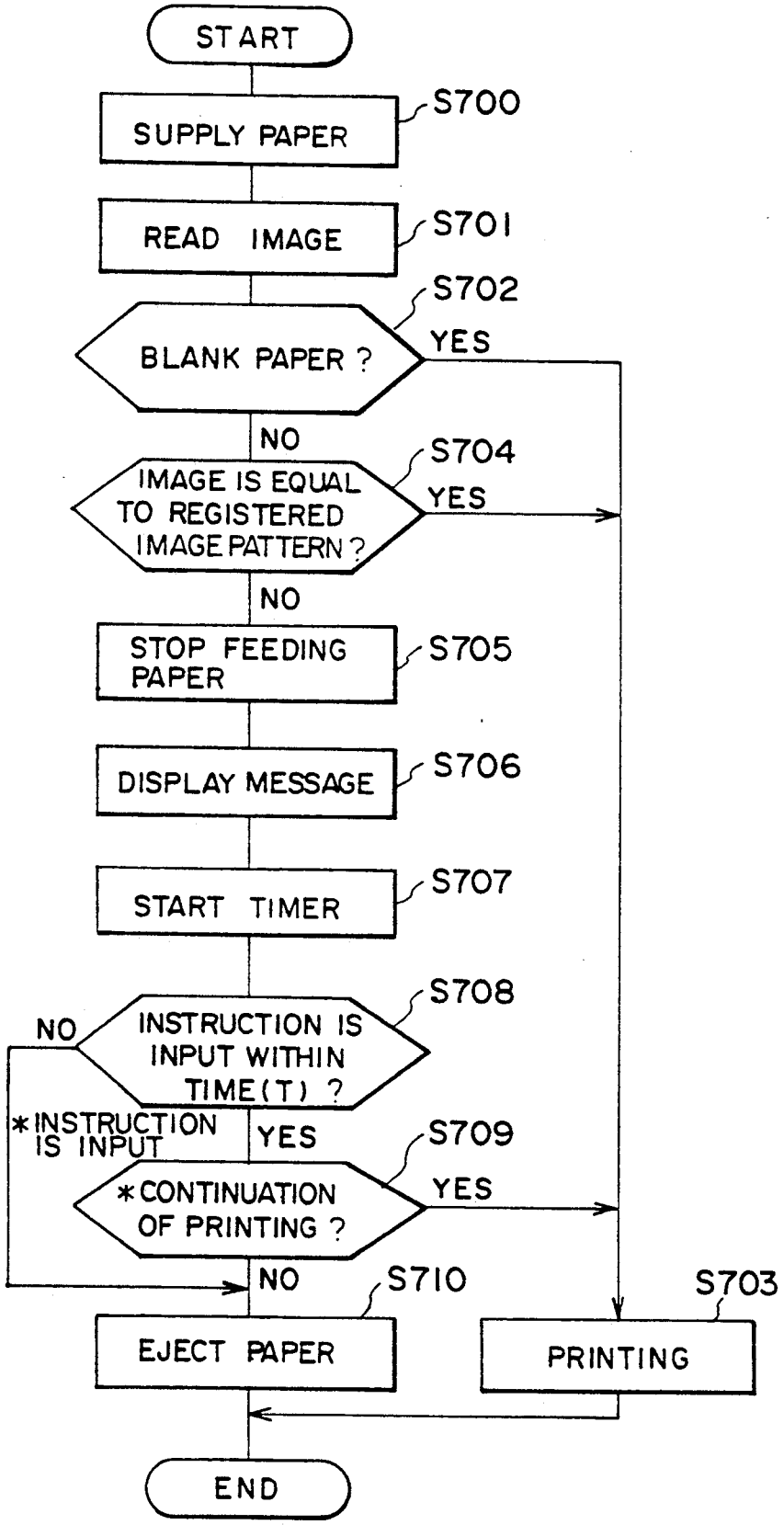

FIG. 11 shows another procedure in accordance with which the CPU 30 controls the printer. The procedure shown in FIG. 11 is obtained by a combination of the procedures shown in FIGS. 9 and 10. That is, steps S700, S701, S702, S703, S704, S705 and S706 shown in FIG. 9 respectively correspond to steps S500, S501, S502, S503, S504, S505 and S506 shown in FIG. 9, and steps S707, S708, S709 and S710 respectively correspond to steps S606, S607, S608 and S309 shown in FIG. 10.

The present invention is not limited to the aforementioned embodiments, and variations and modifications may be made without departing from the scope of the claimed invention. The present invention may be also applied, for example, to other types of printer, such as ink jet printers, dot-matrix printers and thermal transfer printers.

What is claimed is:

1. An image forming apparatus comprising;

printing means for printing an image on a paper;

a paper feed means for feeding a paper to said printing means;

paper supply means, coupled to said paper feed means, for forwarding papers, one by one, to said paper feed means;

detecting means for detecting whether or not a surface of each paper, fed to said printing means by said paper feed means, is blank; and ejecting means, coupled to said detecting means, for ejecting a paper from said paper feed means without printing an image thereon when said detecting means detects that the surface of the paper is not blank, so that only papers having blank surfaces are fed to said printing means.

2. An image forming apparatus as claimed in claim 1, wherein said paper feed means has a paper feed path extending from said paper supply means toward said printing means; and rollers, provided in said paper feed path, for feeding the papers through the paper feed path.

3. An image forming apparatus as claimed in claim 2, wherein said detecting means has an image sensor for optically reading a surface of each paper fed through the paper feed path and for outputting image data, said detecting means detecting, based on the image data output from said image sensor, whether or not the surface of the paper is blank.

4. An image forming apparatus as claimed in claim 2, wherein said ejecting means has a blanch path extending from a predetermined junction in said paper feed path to an ejecting tray; and a switching guide provided provided at the junction, said switching guide being switched to said blanch path so that the paper is forward from said paper feed path to said blanch path via said switching guide and ejected to said ejecting tray via said blanch path when said detecting means detects that the surface of the paper is not blank.

5. An image forming apparatus as claimed in claim 1, further comprising:

stop means for stopping the paper from being fed by said paper feed means when said detecting means detects that the surface of the paper is not blank;

warning means for warning a user that the surface of the paper fed by said paper feed means is not blank;

input means, operated by a user, for inputting a permission instruction for permitting said printing means to print the image on the paper; and first control means for controlling said paper feed means and said ejecting means based on the permission instruction input by said input means so that said ejecting means is inactivated and said paper feed means resumes feeding the paper to said printing means.

6. An image forming apparatus as claimed in claim 5, wherein said warning means has a display unit on which a warning message is displayed.

7. An image forming apparatus as claimed in claim 5 further comprising:

timer means for measuring a time for which the paper is stopped by said stop means; and second control means, coupled to said timer means and said first control means, for inactivating said first control means when the time measured by said timer means reaches a predetermined value without the user inputting the permission instruction, so that the paper is ejected by said ejecting means.

8. An image forming apparatus as claimed in claim 1, wherein said detecting means has image reading means for optically reading images on a paper fed by said paper feed means and for outputting image data, said detecting means detecting, based on the image data output from said image reading means, whether or not the surface of the paper is blank.

9. An image forming apparatus as claimed in claim 8 further comprising:

storage means for storing a predetermined image pattern;

determination means for determining whether or not the image data output from said image reading means corresponds to the image pattern stored in said storage means; and first control means, for controlling said ejecting means so that said ejecting means is inactivated when said determination means determines that the image data corresponds to the image pattern stored in said storage means, whereby the paper on which an image corresponding to the image pattern stored in said storage means can be fed to said printing means by said paper feeding means.

10. An image forming apparatus as claimed in claim 9 further comprising:

stop means for stopping the paper from being be fed by said paper feed means when said determination means determines that the image data does not correspond to the image pattern stored in said storage means;

warning means for warning a user that the image data output from said image reading means does not correspond to the image pattern stored in said storage means;

input means, operated by a user, for inputting a permission instruction for permitting said printing means to print the image on the paper; and second control means for controlling said paper feed means and said first control means based on the permission instruction input by said input means so that said ejecting means is inactivated and said paper feed means resumes feeding the paper to said printing means.

11. An image forming apparatus as claimed in claim 10 wherein said warning means has a display unit on which a warning message is displayed.

12. An image forming apparatus as claimed in claim 10 further comprising:

timer means for measuring a time for which the paper is stopped by said stop means; and third control means, coupled to said timer means and said second control means, for inactivating said second control means when the time measured by said timer means reaches a predetermined value without the user inputting the permission instruction, so that the paper is ejected by said ejecting means.

* * * * *